US005640868A

United States Patent [19]

Lauener

[11] Patent Number: 5,640,868

[45] Date of Patent: Jun. 24, 1997

[54] APPARATUS AND METHOD FOR WORK HARDENING AN ENDLESS BELT FOR USE IN A BELT CASTER

[75] Inventor: Wilhelm F. Lauener, Gerlafingen/SO, Switzerland

[73] Assignee: Larex A.G., Solothurn, Switzerland

[21] Appl. No.: 566,777

[22] Filed: Dec. 28, 1995

[51] Int. Cl.[6] ..... B21B 5/00

[52] U.S. Cl. ..... 72/110; 72/111

[58] Field of Search ..... 72/106, 110, 111, 72/168, 205

[56] References Cited

U.S. PATENT DOCUMENTS

| | | | |
|---|---|---|---|
| 4,002,197 | 1/1977 | Hazelett et al. . | |
| 4,164,134 | 8/1979 | Vollers | 72/168 |
| 4,176,538 | 12/1979 | Kymmell et al. | 72/111 |
| 4,785,873 | 11/1988 | Lauener . | |
| 4,794,978 | 1/1989 | Lauener . | |
| 4,798,315 | 1/1989 | Lauener . | |
| 4,964,456 | 10/1990 | Lauener . | |

FOREIGN PATENT DOCUMENTS

| | | | |
|---|---|---|---|
| 864035 | 6/1978 | Belgium . | |
| 61-162216 | 7/1986 | Japan | 72/111 |

*Primary Examiner*—Lowell A. Larson

*Attorney, Agent, or Firm*—David V. Radack; Eckert Seamans Cherin & Mellott

[57] ABSTRACT

An endless belt work hardening apparatus including a pair of rotatable supporting rolls, a work roll disposed between the supporting rolls and a pair of tension rolls having disposed therebetween the work roll. The endless belt is positioned in the apparatus so that the tension rolls and the work roll engage the inner major surface of the endless belt and the supporting rolls engage against the outer major surface of the endless belt. The tension rolls are moved away from each other and the supporting rolls are rotated to reduce the thickness of the endless belt and work harden the endless belt. Associated methods of work hardening an endless belt for use in a belt caster and manufacturing an endless belt for use in a belt caster are also disclosed.

21 Claims, 2 Drawing Sheets

APPARATUS AND METHOD FOR WORK HARDENING AN ENDLESS BELT FOR USE IN A BELT CASTER

BACKGROUND OF THE INVENTION

This invention relates to an apparatus and method for work hardening a thin steel endless belt which is used in a belt caster for casting molten metal into metal products.

Twin belt continuous casting machines include a tundish which receives molten metal from a furnace, the molten metal being subsequently fed from a nozzle into a casting zone. The casting zone includes a mold which is formed by a pair of opposed movable belts and a pair of opposed movable side dams. The back sides of the belt are cooled by a coolant (typically water) which facilitates removing heat from the solidifying molten metal. The molten metal solidifies in the casting zone and emerges as a metal product which is subsequently moved out of the casting zone at casting speed. One type of belt caster is an endless belt caster which is disclosed in several patents issued to the Hazlett Strip Casting Corporation such as U.S. Pat. No. 4,002,197 and others.

The belts used in these endless belt casters are typically made of steel and must, on the one hand, be thin enough to aid heat transfer from its casting side to its cooling side and, on the other hand, be strong enough to sustain the rigors of casting. In addition, it would be desirable to stretch the belt below elastic yield in order to prevent distortion during casting.

What is needed therefore is an apparatus and method for work hardening an endless belt for use in a twin belt caster that provides a strong, distortion free belt surface that will enhance the quality of the cast metal product while at the same time having a long useful life.

SUMMARY OF THE INVENTION

The method and apparatus of the invention have met or exceeded the above-mentioned needs, as well as others. The endless belt work hardening apparatus of the invention includes a pair of rotatable supporting rolls, a work roll disposed between the supporting rolls and a pair of tension rolls having disposed therebetween the work roll. The endless belt is positioned in the apparatus so that the tension rolls and the work roll engage against the inner major surface of the endless belt and the supporting rolls engage against the outer major surface of the endless belt. The tension rolls are moved away from each other and the supporting rolls are rotated to reduce the thickness of the endless belt and work harden the endless belt.

The method of the invention involves moving an endless belt through a pair of rotating supporting rolls and a pair of tension rolls having disposed therebetween the work roll so that the tension rolls and the work roll can engage against the inner major surface of the endless belt and so that the supporting rolls can engage against the outer major surface of the endless belt. The endless belt is reduced in thickness as it moves between the supporting rolls and the work roll.

A method of manufacturing an endless belt is also provided comprising providing a strip of metal having a pair of ends, joining the ends to form an endless belt and subsequently work hardening the endless belt.

BRIEF DESCRIPTION OF THE DRAWINGS

A full understanding of the invention can be gained from the following description of the preferred embodiment when read in conjunction with the accompanying drawings in which.

DETAILED DESCRIPTION

As used herein, the term "metal product" means primarily clad or unclad strip or slab made substantially of one or more metals, including without limitation, aluminum and aluminum alloys and can also include, in a broader sense, clad or unclad bar, foil or rod.

The apparatus and method described herein are useful for work hardening an endless thin steel belt, preferably made of carbon steel and more preferably having at least 0.4% carbon content, that is used in a belt caster for casting molten metal into metal products. Endless belt casters are disclosed in several patents issued to the Hazlett Strip Casting Corporation, such as U.S. Pat. No. 4,002,197 and others. As mentioned above, it is desirable to work harden these belts in order to enhance performance of the belts and to improve the quality of the cast product. The work hardening of the belts will strengthen the belt thus increasing the useful life of the belt.

Figure 1:
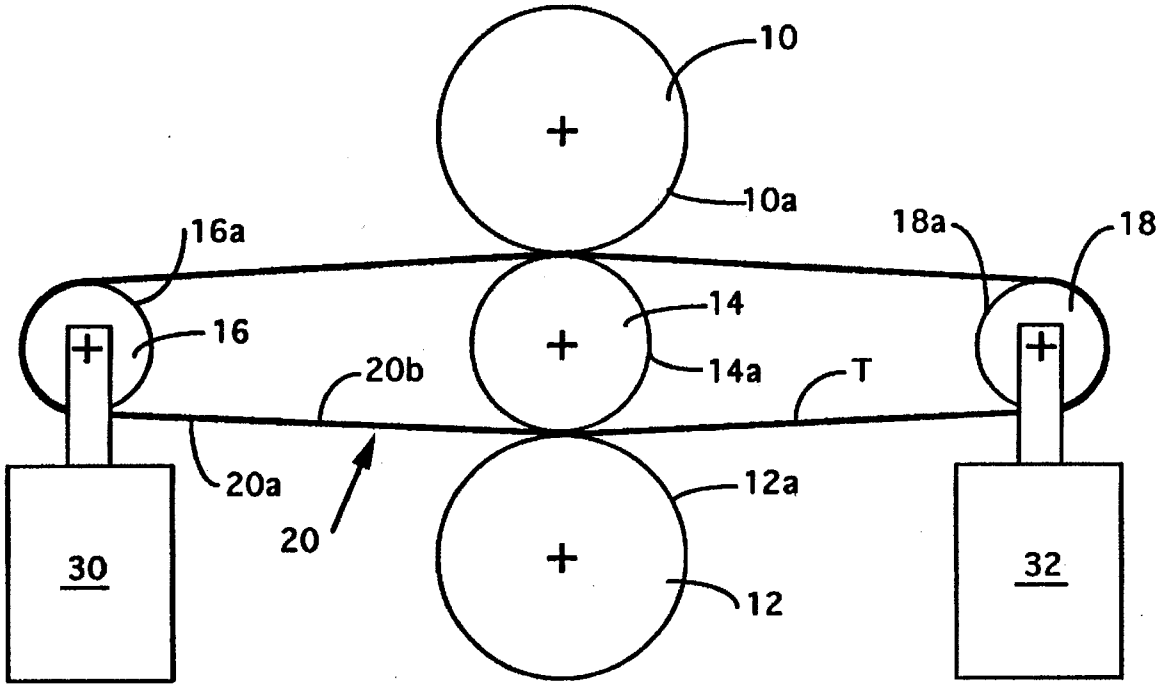
FIG. 1 is a schematic side-elevational view of the belt work hardening apparatus of the invention showing the endless belt in its original position before work hardening.
Figure 2:
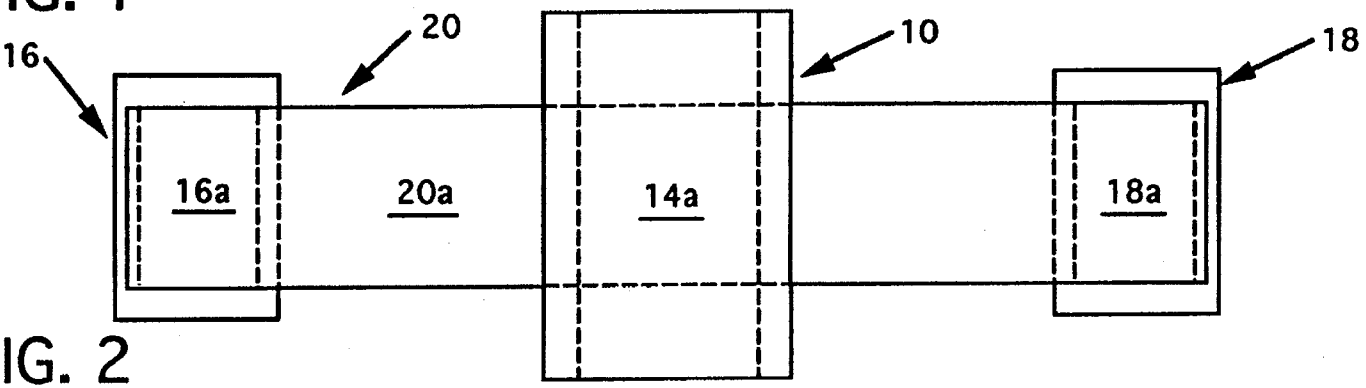
FIG. 2 is a top plan view of the apparatus shown in FIG. 1.

The apparatus for work hardening is shown in FIGS. 1–4. Referring specifically to FIG. 1, the apparatus includes a pair of aligned rotatable supporting rolls 10 and 12, a work roll 14 disposed between the supporting rolls and a pair of aligned tension rolls 16, 18. The endless belt 20, which is preferably an uncoated thin steel belt made of a carbon steel material having at least 0.4% carbon therein, has an outer major surface **20*a* and an inner major surface 20*b*** and a thickness T. The endless belt is made by joining, preferably by welding, the two ends of a strip of thin carbon steel to each other. Carbon steel is used because, among other reasons, of its good welding characteristics.

The belt 20 is positioned in the apparatus so that the outside surfaces **16*a* and 18*a* of the tension rolls 16 and 18 and the outside surface 14*a* of the work roll 14 engage against the inner major surface 20*b* of the belt 20 and so that the outside surfaces 10*a* and 12*a* of supporting rolls 10 and 12 engage against the outer major surface 20*a* of the belt 20. The belt 20 is reduced in thickness and work hardened by moving the belt, under tension, between each of the supporting rolls 10 and 12 and the work roll 14**.

Figure 3:
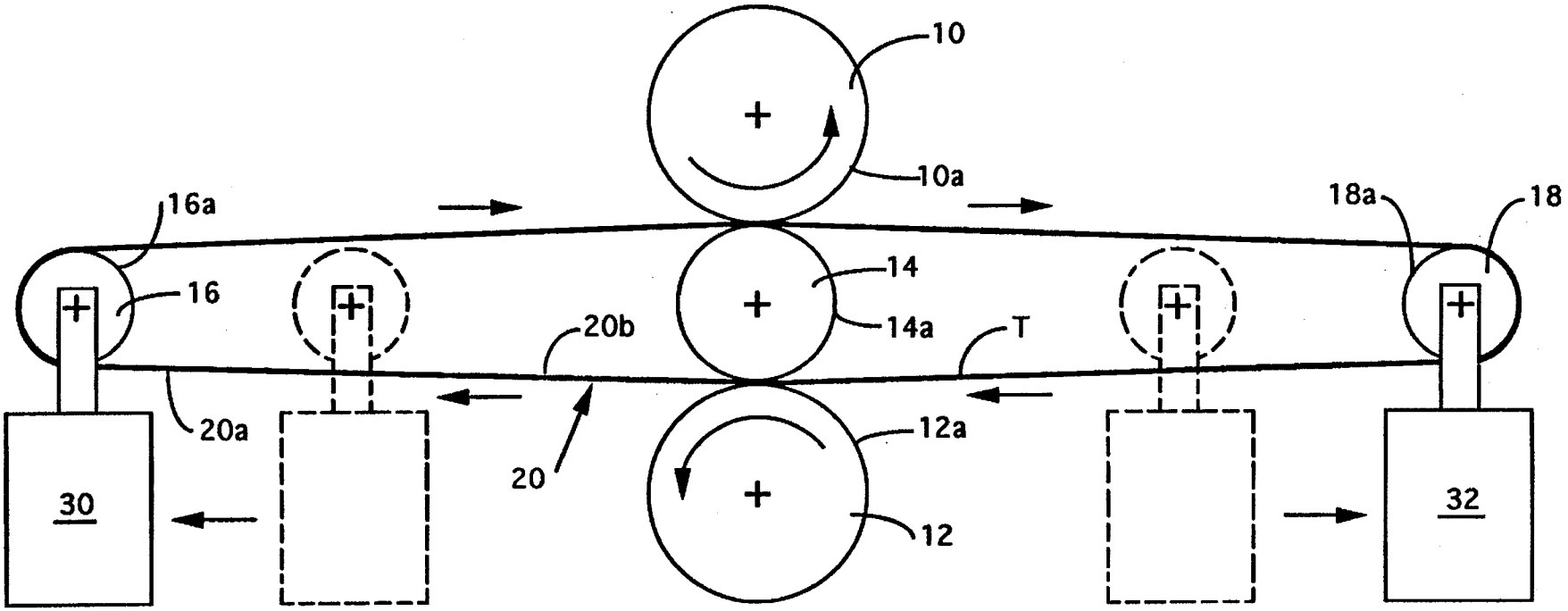
FIG. 3 is a view similar to FIG. 1, only showing the endless belt being work hardened.
Figure 4:
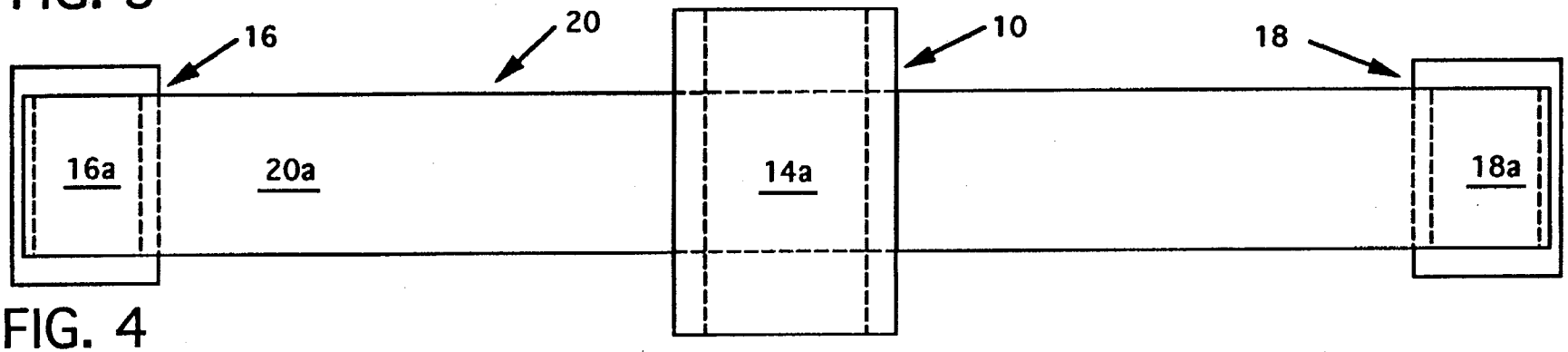
FIG. 4 is a top plan view of the apparatus shown in FIG. 3.

Referring now to FIG. 3, once the belt 20 is in position in the apparatus as described above with respect to FIGS. 1 and 2, the tension rolls 16 and 18 are each moved away from the work roll 14 and the supporting rolls 10 and 12 are rotated to orbit the endless belt 20 in the apparatus. The tension rolls 16 and 18 are moved slowly (as the belt is orbited) from their original position (shown in phantom in FIG. 3) away from the work roll 14 to any desired distance, such as the distance shown in FIG. 3. The belt 20 is thus, in effect, cold rolled under tension in order to work harden the same. Considering that the desired final belt thickness ranges from about 0.25 mm to about 0.63 or 0.75 mm and that the desired cold reduction for achieving the desired work hardened strength level can be around 15 or 20% up to around 70 or 80% preferably around 20 to 60%, typically around 60%, the initial steel thickness of the belt is selected.

The work hardening done by the apparatus can increase the tensile strength of the endless belt from, for example, a starting tensile strength of about 300 Newtons/mm$^2$ to about 800 Newtons/mm$^2$.

It will be appreciated that an apparatus and method for work hardening an endless belt for a caster are disclosed. The apparatus and method increases the tensile strength of the belt and also resists distortion of the belt during casting. This leads to longer belt useful life as well as an improvement in the quality of the cast metal product.

Although the described embodiment shows a pair of supporting rolls 10, 12 and a pair of tension rolls 16, 18, it will be appreciated that work hardening of the endless belt 20 can be accomplished by employing (i) a single supporting roll 10, (ii) a work roll 14 and (iii) a single tension roll 16 or both tension rolls 16 and 18.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An endless belt work hardening apparatus for an endless belt having a thickness, an outer major surface and an inner major surface, said endless belt for use in a belt caster for casting molten metal into a metal product, said apparatus comprising:

a pair of rotatable supporting rolls;

a work roll disposed between said supporting rolls; and a pair of movable tension rolls having disposed therebetween said work roll, said endless belt being positioned in said apparatus so that said tension rolls and said work roll engage against said inner major surface of said endless belt and said supporting rolls engage against said outer major surface of said endless belt so that when said endless belt is moved through said apparatus, said thickness of said endless belt is reduced.

2. The apparatus of claim 1, wherein said tension rolls are mounted on tension roll support carriages.

3. The apparatus of claim 1, wherein said tension rolls are aligned with each other.

4. The apparatus of claim 1, wherein said supporting rolls are aligned with each other.

5. A method of work hardening an endless belt having a thickness, an outer major surface and an inner major surface, said endless belt for use in a belt caster for casting molten metal into a metal product, said method comprising moving said endless belt through a pair of rotating supporting rolls, a work roll disposed between said supporting rolls and a pair of movable tension rolls having disposed therebetween said work roll so that said tension rolls and said work roll can engage against said inner major surface of said endless belt and so that said supporting rolls can engage against said outer major surface of said endless belt, said endless belt being reduced in thickness as it moves between said supporting rolls and said work roll.

6. The method of claim 5, including employing as said endless belt a welded metal strip.

7. The method of claim 6, wherein said endless belt is made of carbon steel.

8. The method of claim 7, wherein said endless belt has at least 0.4% carbon.

9. The method of claim 5, including increasing the tensile strength of said endless belt from 300 Newtons/mm$^2$ to 800 Newtons/mm$^2$.

10. The method of claim 5, including reducing said thickness of said endless belt by 15 to 80% of its original thickness.

11. The method of claim 10, including reducing said thickness of said endless belt by 20 to 60% of its original thickness.

12. The method of claim 11, including reducing said thickness of said endless belt by about 60% of its original thickness.

13. A method of manufacturing an endless belt having a thickness, an outer major surface and an inner major surface, said endless belt for use in a belt caster for casting molten metal into a metal product, said method comprising:

providing a metal strip having a pair of ends;

joining said ends to form an endless belt; and subsequently work hardening said endless belt by moving said endless belt through a pair of rotating supporting rolls, a work roll disposed between said supporting rolls and a pair of movable tension rolls having disposed therebetween said work roll so that said tension rolls and said work roll can engage against said inner major surface of said endless belt and so that said supporting rolls can engage against said outer major surface of said endless belt, said endless belt being reduced in thickness as it moves between said supporting rolls and said work roll.

14. The method of claim 13, including employing as said endless belt a welded metal strip.

15. The method of claim 14, wherein said endless belt is made of carbon steel.

16. The method of claim 15, wherein said endless belt has at least 0.4% carbon.

17. The method of claim 13, including increasing the tensile strength of said endless belt from 300 Newtons/mm$^2$ to 800 Newtons/mm$^2$.

18. The method of claim 13, including reducing said thickness of said endless belt by 15 to 80% of its original thickness.

19. The method of claim 18, including reducing said thickness of said endless belt by 20 to 60% of its original thickness.

20. The method of claim 19, including reducing said thickness of said endless belt by about 60% of its original thickness.

21. An endless belt made by the method of claim 13.

* * * * *

UNITED STATES PATENT AND TRADEMARK OFFICE

CERTIFICATE OF CORRECTION

PATENT NO. : 5,640,868

DATED : June 24, 1997

INVENTOR(S) : Wilhelm F. Lauener

It is certified that error appears in the above-identified patent and that said Letters Patent is hereby corrected as shown below:

Column 2, line 33, --movable-- should be inserted after "aligned".

Signed and Sealed this

Eighth Day of December, 1998

*Attest:*

BRUCE LEHMAN

*Attesting Officer*

*Commissioner of Patents and Trademarks*